US012612684B2

(12) United States Patent
Kang et al.

(10) Patent No.: US 12,612,684 B2
(45) Date of Patent: Apr. 28, 2026

(54) MARTENSITIC STAINLESS STEEL WITH EXCELLENT HARDENABILITY

(71) Applicant: POSCO Co., Ltd, Pohang-si (KR)

(72) Inventors: Hyung-gu Kang, Pohang-si (KR); Dong-hoon Kim, Pohang-si (KR); Gyujin Jo, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 311 days.

(21) Appl. No.: 18/268,562

(22) PCT Filed: Dec. 10, 2021

(86) PCT No.: PCT/KR2021/018705
§ 371 (c)(1),
(2) Date: Jun. 20, 2023

(87) PCT Pub. No.: WO2022/139276
PCT Pub. Date: Jun. 30, 2022

(65) Prior Publication Data

US 2024/0043973 A1 Feb. 8, 2024

(30) Foreign Application Priority Data

Dec. 21, 2020 (KR) ..... 10-2020-0179497

(51) Int. Cl.
*C22C 38/42* (2006.01)
*C22C 38/00* (2006.01)
(Continued)

(52) U.S. Cl.
CPC ..... *C22C 38/42* (2013.01); *C22C 38/001* (2013.01); *C22C 38/02* (2013.01); *C22C 38/04* (2013.01)

(58) Field of Classification Search
None
See application file for complete search history.

(56) References Cited

U.S. PATENT DOCUMENTS

2006/0113008 A1* 6/2006 Hirasawa ..... F16D 65/125 148/325
2009/0104068 A1* 4/2009 Hirasawa ..... C22C 38/002 420/36

(Continued)

FOREIGN PATENT DOCUMENTS

CN 108315650 A 7/2018
JP S61-174361 A 8/1986

(Continued)

OTHER PUBLICATIONS

Office Action dated Jan. 28, 2025 issued in corresponding Japanese Patent Application No. 2023-538061. (Note: JP S61-174361 A already submitted.).

(Continued)

*Primary Examiner* — Seth Dumbris
(74) *Attorney, Agent, or Firm* — Morgan Lewis & Bockius LLP

(57) ABSTRACT

Disclosed is a martensitic stainless steel with excellent hardenability through the control of a component system. The martensitic stainless steel with excellent hardenability comprises, in percent by weight (wt %), 0.01 to 0.1% of C, 0.05 to 0.1% of Si, 0.05 to 1.0 of Mn, 11.0 to 14.0% of Cr, 0.05 to 1.0% of Ni, 0.05 to 2.0% of Cu, to 0.08% of N, and the balance of Fe and inevitable impurities, and satisfies Formula (1).

$$1.0 \leq Mn+Ni+Cu \leq 2.5, \quad \text{Formula (1):}$$

wherein Mn, Ni, and Cu denote contents (wt %) of elements, respectively.

6 Claims, 3 Drawing Sheets

(51) Int. Cl.
*C22C 38/02* (2006.01)
*C22C 38/04* (2006.01)

(56) References Cited

U.S. PATENT DOCUMENTS

| | | | | |
|---|---|---|---|---|
| 2012/0048662 | A1 | 3/2012 | Hirasawa et al. | |
| 2017/0253945 | A1* | 9/2017 | Teraoka | C22C 38/02 |
| 2019/0264298 | A1* | 8/2019 | Nakamura | C21D 8/0405 |

FOREIGN PATENT DOCUMENTS

| | | | |
|---|---|---|---|
| JP | 2001-003142 | A | 1/2001 |
| JP | 2004-346425 | A | 12/2004 |
| JP | 2010-106315 | A | 5/2010 |
| JP | 2016-065301 | A | 4/2016 |
| JP | 2020-152959 | A | 9/2020 |
| KR | 1999-0051476 | A | 7/1999 |
| KR | 10-2008-0106350 | A | 12/2008 |
| KR | 10-2016-0080000 | A | 7/2016 |
| WO | 2008/044299 | A1 | 4/2008 |

OTHER PUBLICATIONS

Japanese Office Action dated Jul. 16, 2024 issued in Japanese Patent Application No. 2023-538061 (with English translation).
International Search Report dated Apr. 13, 2022 issued in International Patent Application No. PCT/KR2021/018705 (with English translation).
Office Action issued in corresponding Chinese Patent Application No. 202180090885.7 issued Jan. 29, 2026, with English translation.

* cited by examiner

MARTENSITIC STAINLESS STEEL WITH EXCELLENT HARDENABILITY

CROSS-REFERENCE OF RELATED APPLICATIONS

This application is the U.S. National Phase under 35 U.S.C. § 371 of International Patent Application No. PCT/KR2021/018705, filed on Dec. 10, 2021 which claims priority to and the benefit of Korean Application No. 10-2020-0179497 filed on Dec. 21, 2020, the entire contents of which are incorporated herein by reference.

TECHNICAL FIELD

The present disclosure relates to a martensitic stainless steel with excellent hardenability, and more particularly, to a martensitic stainless steel with excellent hardenability due to a low hardness deviation.

BACKGROUND

Generally, a material for a disc, for example, used in a two-wheeled vehicle requires high hardness to prevent abrasion of the disc, and accordingly, martensitic stainless steel having high hardness is mainly used.

Martensitic stainless steel includes a ferrite phase and precipitates when manufactured as a plate material, and, for discs, is punched into a disk shape and then subjected to a hardening heat treatment. The hardening heat treatment is a process in which a ferrite phase is heated to a temperature at which the ferrite phase transforms into an austenite phase, and then rapidly cooled after holding for a certain period of time to form a martensite phase. If the martensite phase is formed, a high hardness suitable for discs of two-wheeled vehicles may be obtained.

However, to achieve uniform disc performance, a small amount of hardness deviation is required so that the hardness of each position of a disc is uniform. A large amount of hardness deviation causes pads rubbing against the disc to wear quickly or prevent proper braking performance from being obtained. Accordingly, a martensitic stainless steel having uniform hardness for each location of the disc is required.

SUMMARY

Technical Problem

The present disclosure provides a martensitic stainless steel with excellent hardenability due to a low hardness deviation.

Technical Solution

One aspect of the present disclosure provides a martensitic stainless steel with excellent hardenability comprising, in percent by weight (wt %), 0.01 to 0.1% of C, 0.05 to 1.0% of Si, 0.05 to 1.0 of Mn, 11.0 to 14.0% of Cr, 0.05 to 1.0% of Ni, 0.05 to 2.0% of Cu, 0.04 to 0.08% of N, and the balance of Fe and inevitable impurities, and satisfying Formula (1) below:

$$1.0 \leq Mn+Ni+Cu \leq 2.5 \quad \text{Formula (1):}$$

(wherein Mn, Ni, and Cu denote contents (wt %) of elements, respectively.)

The martensitic stainless steel according to an embodiment of the present disclosure may have an area fraction of ferrite phases of 20% or less in an arbitrary cross section.

In an arbitrary cross section, the number of precipitates having a major axis length of greater than 1 μm may be 2 pieces/100 $\mu m^2$ or less.

The Rockwell hardness deviation in an arbitrary cross section may be 2.0 or less.

Advantageous Effects

A martensitic stainless steel according to various embodiments of the present disclosure may reduce an area fraction of ferrite phases or the number of coarse precipitates by controlling a component system, thereby improving hardenability due to a low hardness deviation.

BEST MODE

Figure 1:
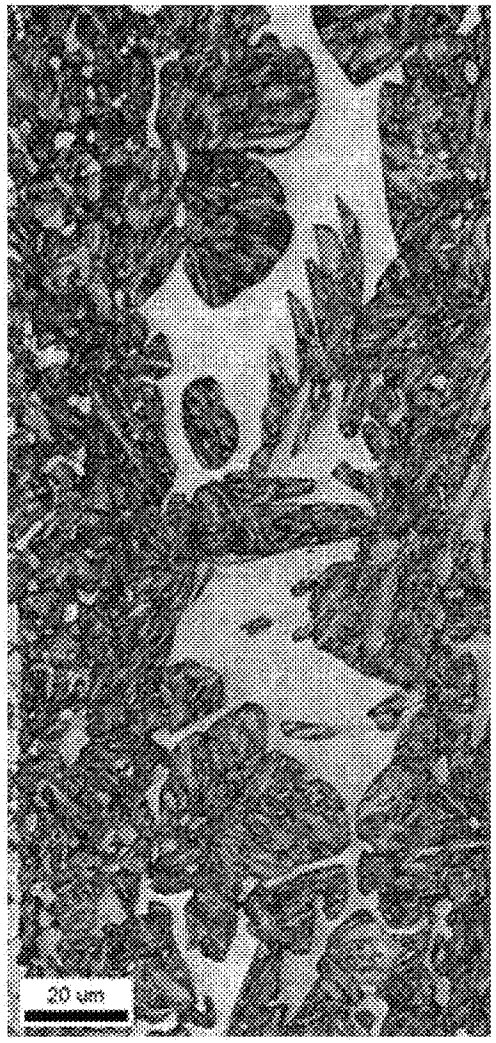
FIG. 1 is a photograph of a ferrite phase and a martensite phase observed in a cross-section of a conventional martensitic stainless steel.

One aspect of the present disclosure provides a martensitic stainless steel excellent hardenability comprising, in percent by weight (wt %), 0.01 to 0.1% of C, 0.05 to 1.0% of Si, 0.05 to 1.0 of Mn, 11.0 to 14.0% of Cr, 0.05 to 1.0% of Ni, 0.05 to 2.0% of Cu, 0.04 to 0.08% of N, and the balance of Fe and inevitable impurities, and satisfying Formula (1) below:

$$1.0 \leq Mn+Ni+Cu \leq 2.5 \quad \text{Formula (1):}$$

wherein Mn, Ni, and Cu denote contents (wt %) of elements, respectively.

DETAILED DESCRIPTION OF THE EMBODIMENTS

Hereinafter, embodiments of the present disclosure will be described in detail with reference to the accompanying drawings. The following embodiments are provided to fully convey the spirit of the present disclosure to a person having ordinary skill in the art to which the present disclosure belongs. The present disclosure is not limited to the embodiments shown herein but may be embodied in other forms. In the drawings, parts unrelated to the descriptions are omitted for clear description of the disclosure, and sizes of elements may be exaggerated for clarity.

Throughout the specification, the term "include" an element does not preclude other elements but may further include another element unless otherwise stated.

As used herein, the singular forms are intended to include the plural forms as well, unless the context clearly indicates otherwise.

A martensitic stainless steel with excellent hardenability according to an embodiment of the present disclosure comprises, in percent by weight (wt %), 0.01 to 0.1% of C, 0.05 to 1.0% of Si, 0.05 to 1.0 of Mn, 11.0 to 14.0% of Cr, 0.05 to 1.0% of Ni, 0.05 to 2.0% of Cu, 0.04 to 0.08% of N, and the balance of Fe and inevitable impurities.

Hereinafter, reasons for numerical limitations on the contents of alloying elements in the embodiment of the present disclosure will be described. Hereinafter, the unit is wt % unless otherwise stated.

The content of carbon (C) is 0.01 to 0.1%.

C is an element that greatly affects hardness, and if the C content is less than 0.01%, a desired level of hardness may not be obtained, and if the C content exceeds 0.1%, the hardness is too high and exceeds the level of hardness required for a disc.

The content of silicon (Si) is 0.05 to 1.0%.

Si is an element that improves corrosion resistance and is added in an amount of 0.05% or more. However, if the Si content exceeds 1.0%, toughness may be impaired during manufacture, so the upper limit is limited to 1.0% or less.

The content of manganese (Mn) is 0.05 to 1.0%.

Mn is an element that helps to form an austenite phase during hardening heat treatment and is added in an amount of 0.05% or more. If the Mn content exceeds 1.0%, corrosion resistance may be impaired, so the upper limit is set to 1.0% or less.

The content of chromium (Cr) is 11.0 to 14.0%.

Cr is an element that improves the corrosion resistance of steel and is added in an amount of 11.0% or more. However, if the Cr content is excessive, it becomes a major factor in increasing the size of precipitate, so the upper limit is limited to 14.0% or less.

The content of nickel (Ni) is 0.05 to 1.0%.

Ni is an element that helps to form an austenite phase during hardening heat treatment and is added in an amount of 0.05% or more. If a large amount of Ni, an expensive element, is added, the manufacturing cost increases, so the upper limit is set to 1.0% or less.

The content of copper (Cu) is 0.05 to 2.0%.

Cu is an element that helps to form an austenite phase during hardening heat treatment and is added in an amount of 0.05% or more. If a large amount of Ni, an expensive element, is added, the manufacturing cost increases, so the upper limit is set to 2.0% or less.

The content of nitrogen (N) is 0.04 to 0.08%.

N is an element that controls the hardness of a disc and contains 0.04% or more. If the N content exceeds 0.08%, the hardness becomes too high as it exceeds the level of hardness required for a disc.

The remaining component of the stainless steel, excluding the alloying elements described above, consists of Fe and unintended impurities inevitably incorporated from raw materials or surrounding environments.

To improve the hardenability of stainless steel, the hardness deviation of each position of stainless steel after the hardening heat treatment needs to be reduced. The hardness deviation of each position of the stainless steel is due to the presence of other phases in addition to the martensite phase on a phase constituting the stainless steel after the hardening heat treatment is performed. If the ferrite phase constituting the stainless steel before the hardening heat treatment is not sufficiently transformed into the austenite phase during the hardening heat treatment, the ferrite phase remains after the hardening heat treatment, thereby increasing the hardness deviation.

Furthermore, to improve the hardenability of stainless steel, no coarse precipitates are required prior to the hardening heat treatment. If large-sized precipitates are present, transformation into the austenite phase is not sufficiently produced during the hardening heat treatment, and as a result, the ferrite phase remains after the hardening heat treatment, thereby increasing the hardness deviation.

According to an embodiment of the present disclosure, a component range capable of reducing the area fraction of the residual ferrite phase after the hardening heat treatment is derived using Formula (1).

$$1.0 \le Mn+Ni+Cu \le 2.5 \qquad \text{Formula (1):}$$

(wherein Mn, Ni, and Cu denote contents (wt %) of elements, respectively.)

When the value of Formula (1) is 1.0 or more and 2.5 or less, the ferrite phase may be sufficiently transformed into the austenite phase during the hardening heat treatment, so that the area fraction of the ferrite phase is made below a certain level. As a result, the hardness deviation is controlled below a reasonable level.

When the value of Formula (1) is 1.0 or more and 2.5 or less, the area fraction of the residual ferrite phase after the hardening heat treatment may be 20% or less, preferably 10% or less, in an arbitrary cross section. Herein, the arbitrary cross section means a plane cut from the martensitic stainless steel in an arbitrary direction after the hardening heat treatment, and in particular, the arbitrary cross section means a plane parallel to a longitudinal direction of a precipitate, a major axis of which is greater than 1 μm.

Furthermore, when the value of Formula (1) is 1.0 to 2.5, the number of coarse precipitates produced before the hardening heat treatment may be reduced. As a result, the hardness deviation may be reduced by preventing the ferrite phase from remaining after the hardening heat treatment.

When the value of formula (1) is 1.0 to 2.5, precipitates, having the major axis length of greater than 1 μm before the hardening heat treatment, may be present in an amount of 2 pieces/100 $\mu m^2$ or less in an arbitrary cross section. Herein, the arbitrary cross section means a plane cut in an arbitrary direction before the hardening heat treatment of martensitic stainless steel.

In addition, the martensitic stainless steel according to an embodiment of the present disclosure may have a value of hardness deviation of 2 or less represented by Formula (2).

$$\sqrt{\frac{1}{10}\sum_{i=1}^{10}([\text{Hardness} - HRC]_i - m)^2} \le 2.0 \qquad (2)$$

(Wherein [Hardness-HRC] is the Rockwell hardness (HRC) measured at an arbitrary cross section, and m is the average of the HRC values measured 10 times.)

When the value of Formula (2) is 2 or less, the hardness of the martensitic stainless steel is uniform, so that wear of pads rubbing against a disc during braking may be reduced, and target braking performance may be achieved.

INVENTIVE EXAMPLE

Stainless steel is cast with the alloy composition shown in Table 1 below and hot rolled to a thickness of 4 mm. The hot rolled thickness may vary depending on the application. After hot rolling, the austenite phase formed during hot rolling is transformed into the ferrite phase by holding at about 750° C. for approximately 20 hours.

TABLE 1

| Example | C | Si | Mn | Cr | Ni | Cu | N | Formula (1) |
|---|---|---|---|---|---|---|---|---|
| Comparative Example 1 | 0.04 | 0.3 | 0.3 | 12.7 | 0.3 | 0.3 | 0.03 | 0.9 |
| Comparative Example 2 | 0.04 | 0.03 | 0.2 | 14.2 | 0.2 | 0.2 | 0.02 | 0.6 |
| Comparative Example 3 | 0.06 | 0.3 | 0.2 | 14.3 | 0.3 | 0.3 | 0.03 | 0.9 |
| Comparative Example 4 | 0.04 | 0.3 | 0.2 | 13.1 | 0.1 | 0.1 | 0.01 | 0.4 |
| Inventive Example 1 | 0.03 | 0.3 | 0.4 | 12.2 | 0.3 | 0.5 | 0.04 | 1.2 |
| Inventive Example 2 | 0.01 | 0.2 | 0.4 | 12.8 | 0.3 | 0.5 | 0.08 | 1.2 |
| Inventive Example 3 | 0.03 | 0.3 | 0.5 | 12.3 | 0.2 | 0.9 | 0.05 | 1.6 |
| Inventive Example 4 | 0.04 | 0.3 | 0.9 | 12.5 | 0.2 | 0.2 | 0.04 | 1.3 |
| Inventive Example 5 | 0.02 | 0.3 | 0.3 | 12.4 | 0.9 | 0.3 | 0.05 | 1.5 |
| Inventive Example 6 | 0.03 | 0.4 | 0.3 | 12.1 | 0.3 | 1.4 | 0.05 | 2.0 |
| Inventive Example 7 | 0.04 | 0.4 | 0.3 | 13.8 | 0.2 | 1.9 | 0.04 | 2.4 |
| Inventive Example 8 | 0.09 | 0.9 | 0.1 | 11.1 | 0.2 | 0.8 | 0.06 | 1.1 |

The size (μm) and distribution density (piece/100 $\mu m^2$) of the precipitates are measured for the stainless steel prepared as described above. The size and distribution density of the precipitates may be obtained by observing the residual tissue excluding the precipitates with a scanning electron microscope (SEM) after etching. A method of etching may include any method accepted in academia or industry.

Thereafter, after being machined to a disc shape, the stainless steel is held at 1000° C. for 1 minute and then cooled with water to measure the area fraction (%) of the ferrite phase. The area fraction of the ferrite phase may be confirmed by observing an arbitrary cross section with backscatter electron diffraction mounted on a SEM and then displaying an image quality map. A method of measuring the area fraction may include any method accepted in academia or industry.

Furthermore, to determine whether the hardness is suitable for a disc application, the hardness deviation is calculated according to Formula (2) after measuring Rockwell-C (HRC) 10 times in an arbitrary cross section. Each result is described in Table 2.

TABLE 2

| Example | Area fraction of ferrite phase (%) | Precipitate having a major axis length greater than 1 μm (piece/100 $\mu m^2$) | Formula(2) [hardness deviation] |
|---|---|---|---|
| Comparative Example 1 | 12 | 3 | 4 |
| Comparative Example 2 | 35 | 10 | 10 |
| Comparative Example 3 | 11 | 6 | 6 |
| Comparative Example 4 | 25 | 5 | 15 |
| Inventive Example 1 | 5 | 1 | 2 |
| Inventive Example 2 | 8 | 0 | 1.5 |
| Inventive Example 3 | 6 | 1 | 2 |
| Inventive Example 4 | 2 | 0 | 0.5 |
| Inventive Example 5 | 3 | 1 | 1 |
| Inventive Example 6 | 4 | 0 | 1.5 |
| Inventive Example 7 | 5 | 2 | 2 |
| Inventive Example 8 | 4 | 0 | 2 |

As shown in Table 1 and Table 2 together, the values of Formula (1) for the steel grades of Inventive Examples 1 to 8 satisfy 1.0 to 2.5, the number of precipitates having the major axis length greater than 1 μm in an arbitrary cross section before the hardening heat treatment is 2 pieces/100 $\mu m^2$ or less, and the area fraction of the ferrite phase in an arbitrary cross section after the hardening heat treatment is 20% or less, thereby confirming that the hardness deviation is 2 or less.

In contrast, the values of Formula (1) for Comparative Examples 1 and 3 are 0.9 or less, the number of precipitates having the major axis length greater than 1 μm is 3 pieces/100 $\mu m^2$ or more, and the hardness deviation is also 4 or more, thereby confirming that it is not suitable as a disc for a two-wheeled vehicle that the hardness deviation of 2 or less is recommended.

Meanwhile, in Comparative Examples 2 and 4, which do not satisfy the composition range of the present disclosure, the values of Formula (1) are 0.6 or less, the area fraction of the ferrite phase exceeds 20%, and the number of precipitates having the major axis length greater than 1 μm, is 5 pieces/100 $\mu m^2$ or more. In addition, the hardness deviation is also 10 or more, thereby confirming that the farther the value of Formula (1) is away from the range of 1.0 to 2.5, the more the hardness deviation increases.

Figure 2:
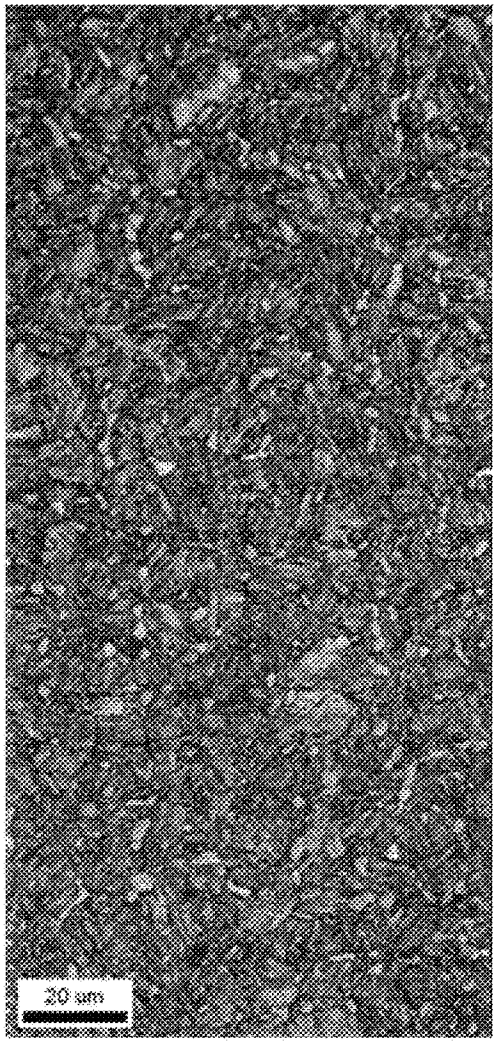
FIG. 2 is a photograph of a ferrite phase and a martensite phase observed in a cross-section of a martensitic stainless steel according to an embodiment of the present disclosure.

FIG. 1 is a photograph of a ferrite phase and a martensite phase observed in a cross section of a conventional martensitic stainless steel, and FIG. 2 is a photograph of a ferrite phase and a martensite phase observed in a cross section of a martensitic stainless steel according to an embodiment of the present disclosure.

As shown in FIG. 1 and FIG. 2, bright fields represent the ferrite phases, and dark needle-like fields represent the martensite phases.

Referring to FIG. 1, it can be seen that the area fraction of the ferrite phases exceeds 20%. However, referring to FIG. 2, it can be seen that the area fraction of the ferrite phases is 20% or less as proposed in the present disclosure, which is almost not present.

Figure 3:
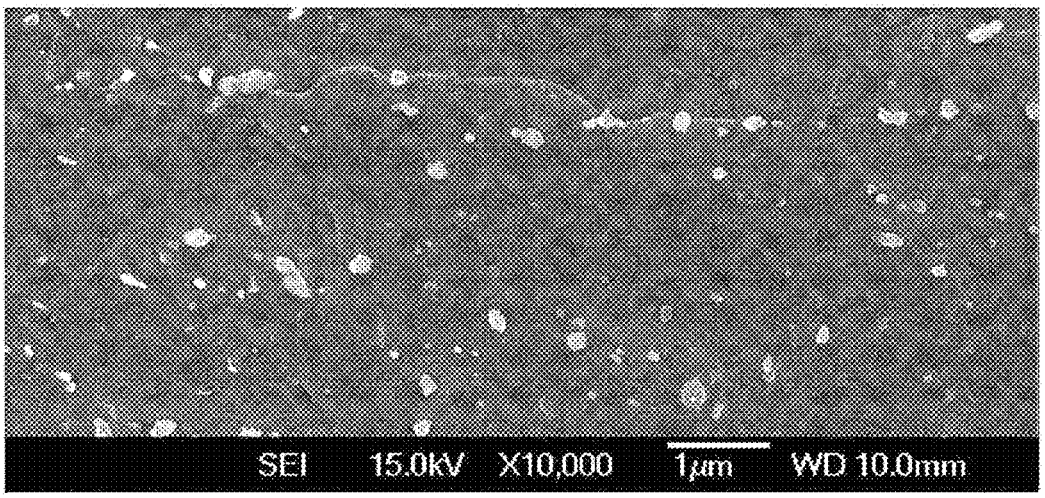
FIG. 3 is a photograph of precipitates observed in a cross-section of a martensitic stainless steel according to an embodiment of the present disclosure.

FIG. 3 is a photograph of precipitates observed in a cross-section of a martensitic stainless steel according to an embodiment of the present disclosure.

Referring to FIG. 3, it can be seen that the number of precipitates having the major axis length greater than 1 μm is 2 pieces/100 $\mu m^2$ or less, and micro-precipitates having the major axis length of 1 μm or less are present, as proposed in the present disclosure.

While the present disclosure has been particularly described with reference to exemplary embodiments, it should be understood by those skilled in the art that various changes in form and details may be made without departing from the spirit and scope of the present disclosure.

INDUSTRIAL APPLICABILITY

The martensitic stainless steel according to the present disclosure has improved hardenability due to a low hardness.

The invention claimed is:

1. A martensitic stainless steel with excellent hardenability comprising, in percent by weight (wt %), 0.01 to 0.1% of C, 0.05 to 1.0% of Si, 0.05 to 1.0 of Mn, 11.0 to 14.0% of Cr, 0.05 to 1.0% of Ni, 0.05 to 2.0% of Cu, 0.04 to 0.08% of N, and the balance of Fe and inevitable impurities, and satisfying Formula (1) below:

$$1.0 \leq Mn+Ni+Cu \leq 2.5, \quad \text{Formula (1):}$$

wherein Mn, Ni, and Cu denote contents (wt %) of elements, respectively, wherein the number of precipitates having a major axis length of greater than 1 μm is 2 pieces/100 $\mu m^2$ or less in an arbitrary cross section, and wherein a Rockwell hardness deviation is 2.0 or less in an arbitrary cross section.

2. The martensitic stainless steel of claim 1, wherein an area fraction of ferrite phase is 20% or less in an arbitrary cross section.

3. The martensitic stainless steel of claim 1, comprising, in percent by weight (wt %), 0.2 to 2.0% of Cu.

4. The martensitic stainless steel of claim 1, comprising, in percent by weight (wt %), 0.3 to 2.0% of Cu.

5. The martensitic stainless steel of claim 1, wherein the martensitic stainless steel satisfies Formula (1') below:

$$1.5 \leq Mn+Ni+Cu \leq 2.5. \quad \text{Formula (1'):}$$

6. The martensitic stainless steel of claim 1, wherein the martensitic stainless steel satisfies Formula (1') below:

$$1.6 \leq Mn+Ni+Cu \leq 2.5. \quad \text{Formula (1'):}$$

* * * * *